US008191647B2

(12) United States Patent
Cordell et al.

(10) Patent No.: US 8,191,647 B2
(45) Date of Patent: Jun. 5, 2012

(54) DRY SPRINKLER INSTALLATION AND SEALING DEVICE

(75) Inventors: Robert M. Cordell, Worcester, MA (US); Manuel R. Silva, Jr., Cranston, RI (US); David Stevens, Riverview, FL (US)

(73) Assignee: Tyco Fire Products LP, Lansdale, PA (US)

( * ) Notice: Subject to any disclaimer, the term of this patent is extended or adjusted under 35 U.S.C. 154(b) by 0 days.

(21) Appl. No.: 11/694,128

(22) Filed: Mar. 30, 2007

(65) Prior Publication Data

US 2007/0169946 A1 Jul. 26, 2007

Related U.S. Application Data

(63) Continuation of application No. 10/998,706, filed on Nov. 29, 2004, now Pat. No. 7,213,319.

(51) Int. Cl.
*A62C 37/36* (2006.01)

(52) U.S. Cl. ..... 169/37; 169/17; 52/58

(58) Field of Classification Search ..... 169/37; 52/58; 126/502
See application file for complete search history.

(56) References Cited

U.S. PATENT DOCUMENTS

| | | | | | |
|---|---|---|---|---|---|
| 2,155,990 | A | * | 4/1939 | Hodgman, Jr. | 169/39 |
| 3,135,331 | A | * | 6/1964 | Lee | 169/17 |
| 3,194,316 | A | * | 7/1965 | Faulkner et al. | 169/37 |
| 3,436,880 | A | * | 4/1969 | Kifer | 52/58 |
| 3,451,483 | A | * | 6/1969 | Elliott et al. | 169/37 |
| 3,529,671 | A | * | 9/1970 | Charles, Jr. | 169/41 |
| 4,019,582 | A | | 4/1977 | Gangell | |
| 4,043,313 | A | * | 8/1977 | Sherman | 126/502 |
| 4,083,410 | A | * | 4/1978 | Anderson | 169/37 |
| 4,086,736 | A | * | 5/1978 | Landrigan | 52/220.8 |
| 4,195,778 | A | * | 4/1980 | Hyten et al. | 126/502 |
| 4,237,982 | A | * | 12/1980 | Sclafani | 169/37 |
| 4,333,660 | A | | 6/1982 | Cupit | |
| 4,363,199 | A | * | 12/1982 | Kucheria et al. | 52/220.8 |
| 4,431,198 | A | * | 2/1984 | Beinhaur et al. | 277/314 |

(Continued)

FOREIGN PATENT DOCUMENTS

CA 2 292 716 7/2000

(Continued)

OTHER PUBLICATIONS

Golinveaux A Technical Analysis: The Use and Maintenance of Dry Type Sprinklers.*

(Continued)

*Primary Examiner* — Len Tran
*Assistant Examiner* — Trevor E McGraw
(74) *Attorney, Agent, or Firm* — Perkins Coie LLP

(57) ABSTRACT

A dry sprinkler installation and sealing device for a cold environment is disclosed. The dry sprinkler installation includes a supply conduit having a first end adapted to communicate with a fire retardant fluid source and a second end supporting a sprinkler head. The supply conduit is dimensioned to extend through an opening in a wall of a cold environment, e.g., a freezer ceiling. A flexible sealing device is positioned about the supply conduit adjacent an exterior surface of the cold environment. A first end of the sealing device is secured about the supply conduit and a second end of the sealing device is secured to an exterior surface of the cold environment. The flexible sealing device allows for radial and axial adjustments to the supply conduit and sprinkler head without comprising the integrity of the sealing device.

23 Claims, 4 Drawing Sheets

U.S. PATENT DOCUMENTS

| | | | | | |
|---|---|---|---|---|---|
| 4,524,262 | A | * | 6/1985 | Meyer | 219/213 |
| 4,664,390 | A | * | 5/1987 | Houseman | 277/606 |
| 4,719,723 | A | * | 1/1988 | Van Wagoner | 52/15 |
| 4,872,512 | A | * | 10/1989 | Multer | 169/51 |
| 4,928,443 | A | * | 5/1990 | Goodman et al. | 52/58 |
| 5,002,318 | A | * | 3/1991 | Witter | 285/302 |
| 5,065,553 | A | * | 11/1991 | Magid | 52/58 |
| 5,144,777 | A | * | 9/1992 | Fishel et al. | 52/144 |
| 5,213,542 | A | * | 5/1993 | Kelly | 454/357 |
| 5,415,239 | A | * | 5/1995 | Kotter et al. | 169/41 |
| 5,649,598 | A | | 7/1997 | MacDonald, III | |
| 5,711,116 | A | * | 1/1998 | Hasan | 52/58 |
| 5,753,149 | A | * | 5/1998 | Shepherd et al. | 261/111 |
| 5,778,611 | A | * | 7/1998 | Michel | 52/198 |
| 5,842,855 | A | * | 12/1998 | Nakamura | 432/242 |
| 5,866,064 | A | * | 2/1999 | Teruhisa | 266/110 |
| 5,967,240 | A | * | 10/1999 | Ondracek | 169/38 |
| 6,000,420 | A | * | 12/1999 | Nicholson et al. | 137/15.01 |
| 6,109,058 | A | * | 8/2000 | Franklin, Jr. | 62/384 |
| 6,484,809 | B1 | | 11/2002 | Elder | |
| 6,862,852 | B1 | * | 3/2005 | Beele | 52/220.8 |
| 2003/0178206 | A1 | * | 9/2003 | Ringer | 169/17 |
| 2004/0163824 | A1 | * | 8/2004 | Ringer | 169/22 |
| 2005/0028456 | A1 | * | 2/2005 | McLane et al. | 52/58 |
| 2005/0055889 | A1 | * | 3/2005 | Thaler | 52/58 |
| 2005/0098961 | A1 | * | 5/2005 | Skinner | 277/617 |
| 2005/0150176 | A1 | * | 7/2005 | Erekson | 52/58 |
| 2005/0167975 | A1 | * | 8/2005 | Skinner | 285/4 |
| 2006/0049627 | A1 | * | 3/2006 | Happel | 285/230 |
| 2006/0130411 | A1 | * | 6/2006 | Edgar et al. | 52/58 |

FOREIGN PATENT DOCUMENTS

| | | |
|---|---|---|
| GB | 2 399 013 | 9/2004 |

OTHER PUBLICATIONS

Tyco/Fire & Building Products; Technical Data, "Series DS-2-11.2 K-factor** Dry Type Sprinklers Standard & Quick Response, Standard Coverage"; Apr. 2004; 8 sheets.

Tyco/Fire & Building Products; Technical Data, "Series DS-C-5.6 K-factor Dry Pendent Concealed Sprinklers Quick and Standard Response, Standard Coverage"; Dec. 2003; 6 sheets.

Tyco/Fire & Building Products; Technical Data, "Series DS-1-5.6 K-factor Dry Type Sprinklers Standard Response, Standard Coverage"; Apr. 2004; 8 sheets.

James E. Golinveaux; "A Technical Analysis: The Use and Maintenance of Dry Type Sprinklers" (http://www.tyco-fire.com/TFP_common/DrySprinklers.pdf); Jun. 2002; 15 pages.

Dec. 3, 2008 Extended EP Search Report including Nov. 25, 2008 Supplemental EP Search Report and Dec. 3, 2008 EP Search Opinion issued in corresponding EP Appln No. 05852392.9.

Intellectual Property Office of New Zealand; Examination Report of counterpart New Zealand Patent Application No. 555397; May 29, 2009; 1 page.

Communication Pursuant to Article 94(3) issued by EPC in related co-pending European Regional Patent Application No. 05 852 392.9-1258, Dec. 22, 2009, 3 pages.

Examination Report issued in co-pending New Zealand Patent Application No. 555397, May 29, 2009, 1 page.

First Office Action issued in co-pending Chinese Application No. 200580040605.2, Jun. 21, 2010, Chinese and English version, 11 pages.

Examination Report issued in related co-pending Australian Application No. 2005309392 Oct. 19, 2010, 2 pages.

Examination Report and Notice of Acceptance of Complete Specification issued in related co-pending New Zealand Application No. 555397, Dec. 9, 2010, 2 pages.

Response to May 29, 2009 Examination Report issued in related co-pending New Zealand Application No. 555397 Nov. 17, 2010; 7 pages.

Apr. 13, 2011 Intellectual Property of New Zealand—IP Database Extract and application as filed on Nov. 25, 2005 for related co-pending New Zealand Application No. 555397; 18 pages.

Communication Under Rule 71(3) EPC issued in related co-pending European Application No. 05 852 392.9-1258, Nov. 15, 2010, 20 pages.

* cited by examiner

DRY SPRINKLER INSTALLATION AND SEALING DEVICE

This application is a continuation of U.S. Ser. No. 10/998,706 filed Nov. 29, 2004, which is currently pending.

BACKGROUND

1. Technical Field

The present disclosure relates to dry sprinkler installations and, more particularly, to a sealing device for use with a dry sprinkler freezer installation.

2. Background to Related Art

Dry sprinkler installations for use in fire protection systems are well known. Typically, dry sprinkler installations include a fluid supply conduit having a first end supporting a sprinkler head and a second end communicating with a fluid main. The sprinkler head includes a thermally responsive device which when activated allows water, nitrogen or other fire retarding agent to flow through the fluid supply conduit and exit the sprinkler head.

The use of dry sprinkler installations in cold environments such as freezers is well known. Typically, in a dry sprinkler installation for a cold environment, the sprinkler supply conduit extends through a hole or opening in the ceiling of the cold environment and an annulus between the supply conduit and the inner diameter of the opening is filled with a spray-foam type of insulation. Thereafter, when the spray-foam insulation hardens or solidifies, it becomes rigid and brittle and does not allow for any movement of the supply conduit or sprinkler head. As a result, any adjustments to the supply conduit or sprinkler head can produce cracks in the spray-foam insulation. If the spray-foam insulation does crack, the thermal insulation properties of the spray-foam insulation are compromised and warm air is able to travel into the cold environment. This can be problematic to the dry sprinkler installation. More specifically, because warm air outside the cold environment generally has a higher relative humidity than the cold air within the cold environment, the cold temperature in the cold environment causes the moisture in the warm air to condense. As the moisture condenses, water droplets form and can accumulate around and on the sprinkler head. As these droplets freeze, ice may accumulate on the sprinkler head. A significant accumulation of ice on the sprinkler head may impair the operability of the sprinkler head such as to delay or prevent operation of the sprinkler head in the event of a fire or effect premature operation of the sprinkler head in absence of a fire.

Accordingly, a continuing need exists in the sprinkler installation art for an apparatus and a method for installing a dry sprinkler installation in a cold environment which provides adequate sealing yet allows for adjustments and/or maintenance to be performed on the sprinkler head and/or supply conduit.

SUMMARY

In accordance with the present disclosure, a dry sprinkler installation for a cold environment is provided which includes a supply conduit having a first end adapted to communicate with a fluid main and a second end supporting a sprinkler head and a sealing device for sealing the annulus defined between the supply conduit and the inner diameter of an opening in a support structure, e.g., a cold environment or freezer. The annular sealing device includes a body which defines a throughbore having a first end dimensioned to sealingly engage the outer circumference of the supply conduit and a second end configured to engage an exterior surface of the support structure. In one preferred embodiment, the second end of the annular sealing device includes a radial flange which is secured to the exterior surface of the support structure with an adhesive, e.g., an ethyl cyanoacrylate adhesive. In another preferred embodiment, the first end of the annular sealing device is secured about the supply conduit using flexible ties, e.g., nylon ties.

In one embodiment, the body of the annular sealing device is formed from a flexible material which permits a limited degree of axial and radial movement of the supply conduit and/or sprinkler head in relation thereto without damaging the annular seal. The flexible material is preferably a rubber, e.g., EPDM rubber, although the use of other known flexible materials is envisioned.

A method for installing a dry sprinkler system adjacent a cold environment, e.g., a freezer, is also provided. The method includes the steps of 1) providing a dry sprinkler including a supply conduit having a first end adapted to communicate with a fluid supply main and a second end supporting a sprinkler head; 2) positioning the supply conduit through an opening formed in a wall of the cold environment such that the sprinkler head is positioned within the cold environment; 3) positioning a flexible annular sealing device about the supply conduit such that the flexible annular sealing device is positioned externally of the cold environment; 4) securing the first end of the annular sealing device about the supply conduit; and 5) securing the second end of the annular sealing device to an exterior surface of the cold environment. In a preferred embodiment, the first end of the annular sealing device is secured to the supply conduit using at least one tie, e.g., a nylon tie, and the second end of the annular sealing device is secured to the exterior surface of the cold environment using an adhesive, e.g., an ethyl cyanoacrylate adhesive.

BRIEF DESCRIPTION OF THE DRAWINGS

Various preferred embodiments of the presently disclosed dry sprinkler installation and sealing device are described herein with reference to the drawings, wherein.

DETAILED DESCRIPTION OF PREFERRED EMBODIMENTS

Figure 1:
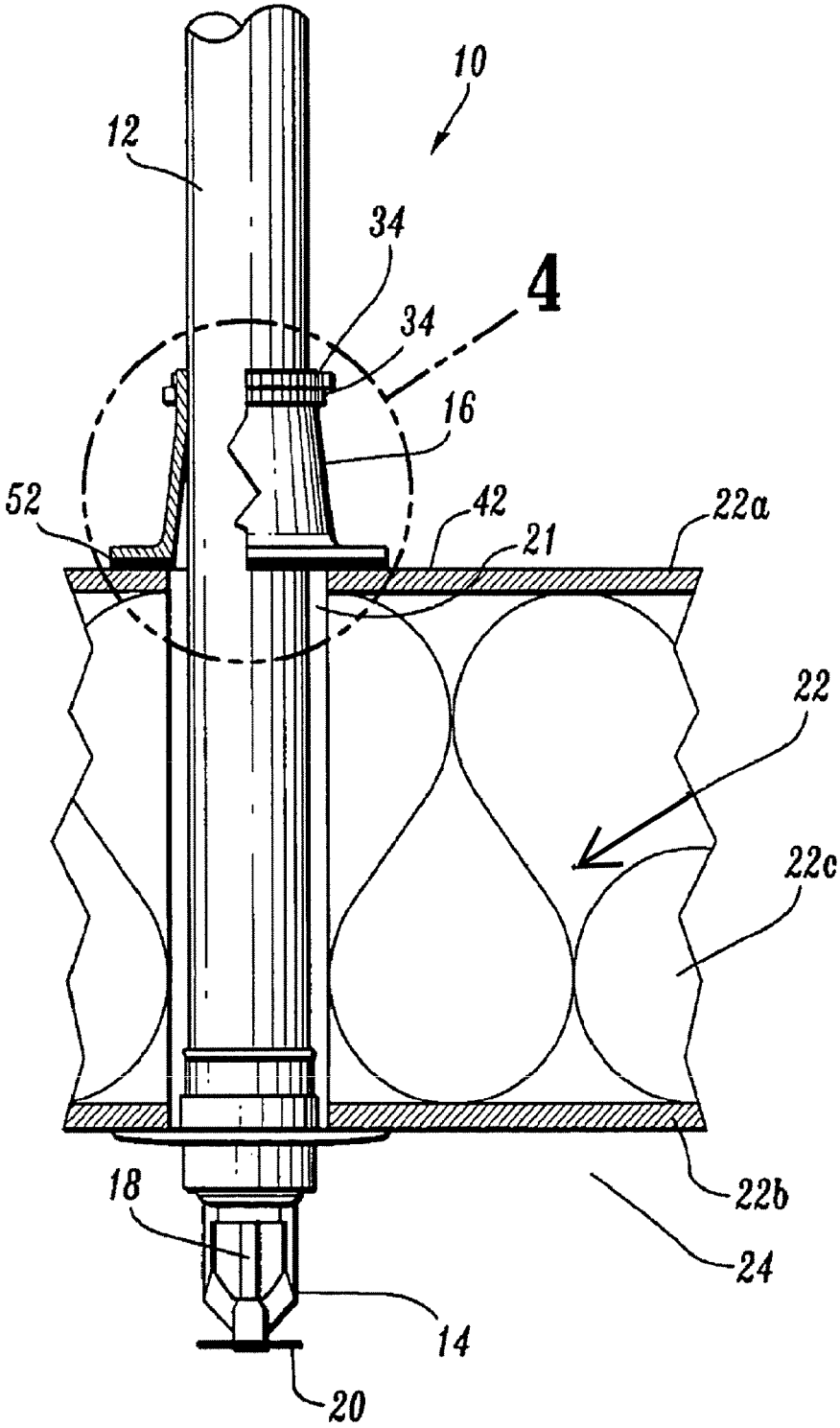
FIG. 1 is a side cross-sectional view of one preferred embodiment of the presently disclosed dry sprinkler installation and sealing device.

Preferred embodiments of the presently disclosed dry sprinkler installation and sealing device are disclosed herein with reference to the drawings, in which like reference numerals designate identical or corresponding elements in each of the several views.

Referring to FIG. 1, the presently disclosed dry sprinkler installation and sealing device is shown generally as 10. Briefly, dry sprinkler installation 10 includes a supply conduit or sprinkler casing 12, a sprinkler head 14, and a sealing device 16. Sprinkler head 14 is known in the art and, typically, includes a thermally responsive device 18 and a fluid deflector 20. In the event of a fire, thermally responsive device 18 reacts to heat generated by the fire to allow fluid to flow through supply conduit 12 and into deflector 20 where the fluid is dispersed outwardly to extinguish the fire. Although a fluid commonly used in such dry sprinkler installations is water, other fire retardant fluids including nitrogen and halogen, may also be used in dry sprinkler installation 10.

As illustrated in FIG. 1, supply conduit 12 is positioned to extend through an opening 21 in a wall 22, e.g., the ceiling, of a cold environment 24. Cold environment 24 may be a freezer or the like. Typically, in a freezer, wall 22 will include an outer wall 22*a*, an inner wall 22*b* and an insulated central portion 22*c* positioned between the inner and outer walls 22*a* and 22*b*. Supply conduit 12 is positioned through hole 21 such that sprinkler head 14 is positioned within cold environment 24 and sealing device 16 is positioned about supply conduit 12 adjacent outer wall 22*a* of cold environment 24. As will be described in detail below, sealing device 16 provides an airtight seal between supply conduit 12 and wall 22 of cold environment 24.

Figure 2:
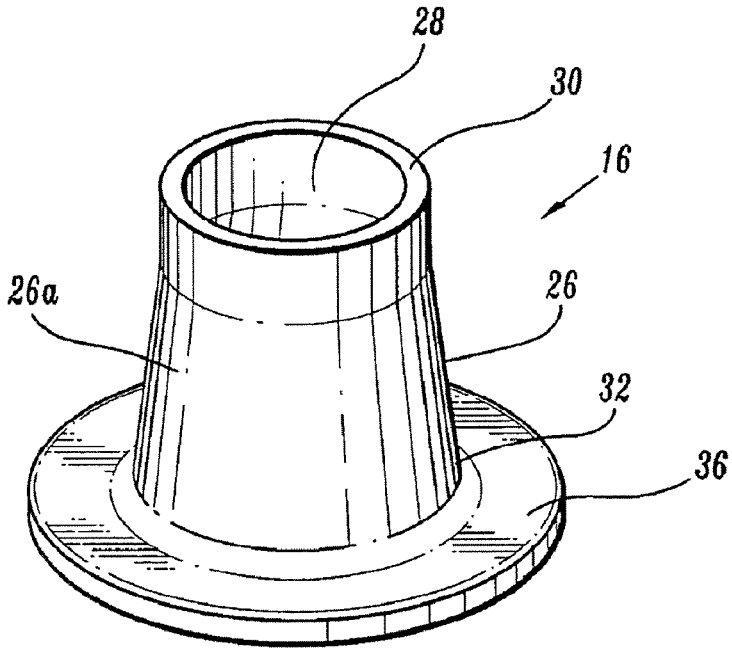
FIG. 2 is a perspective view of the sealing device shown in FIG. 1.
Figure 3:
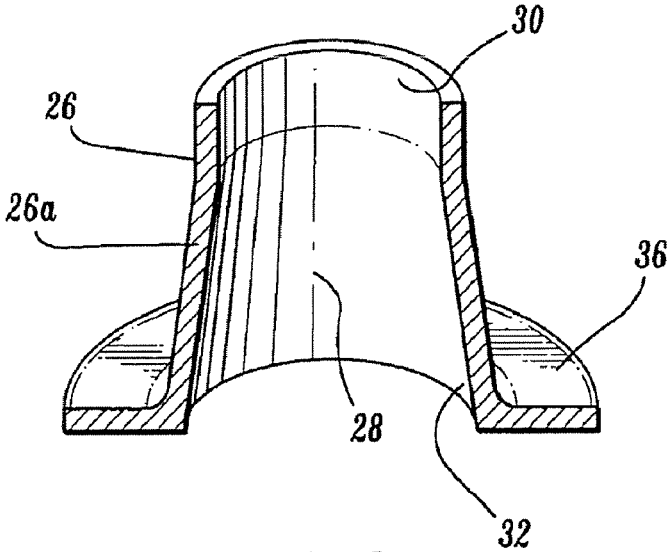
FIG. 3 is a cross-sectional view of the sealing device shown in FIG. 2.
Figure 4:
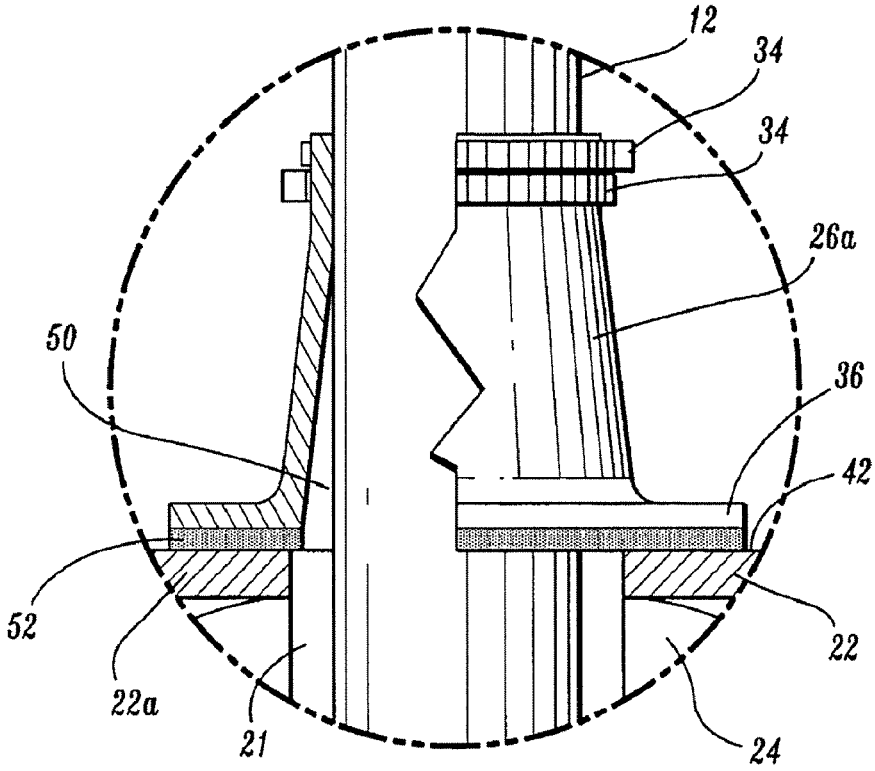
FIG. 4 is an enlarged view of the indicated area of detail shown in FIG. 1.

Referring also to FIGS. 2-4, sealing device 16 includes a body 26 defining a throughbore 28 having a first end 30 and a second end 32. Body 26 is formed from a flexible material which allows for radial and axial adjustments to sprinkler head 14 and supply conduit 12 without damaging sealing device 16. Preferably, sealing device 16 is molded from rubber, e.g., an ethylene propylene diene terpolymer rubber (EPDM) although other flexible materials including neoprene, natural rubbers, and polyisoprenes may be used to form sealing device 16. Preferably, first end 30 of body 26 is dimensioned to fit snugly about supply conduit 12. In one embodiment, at least one flexible tie 34, e.g., a nylon tie, is provided to sealingly secure first end 30 of body 26 about supply conduit 12. Alternately, other securement devices may be used to secure first end 30 about supply conduit 12 including hose clamps, adhesives, etc.

Figure 5:
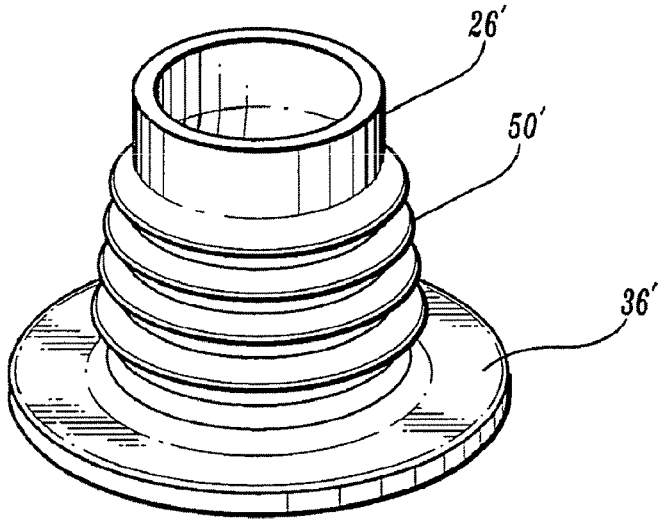
FIG. 5 is a side perspective view of another preferred embodiment of the presently disclosed sealing device.

Second end 32 of body 26 includes a radial flange 36. Preferably, body 26 of sealing device 16 is substantially conical in shape and allows for radial and axial movement of supply conduit 12 and sprinkler head 14 without compromising the integrity of the seal. The conical portion 26*a* of body 26 also defines a chamber 50 (FIG. 4) with supply conduit 12 for capturing stagnant air. Stagnant air is known for having excellent thermal insulation properties. Alternately, it is envisioned that body 26 may have other configurations. For example, as shown in FIG. 5, body 26' may have a bellows portion 50' which also facilitates radial and axial movement of the supply conduit and sprinkler head.

Referring specifically to FIGS. 1 and 4, sealing device 16 is positioned about supply conduit 12 such that radial flange 36 abuts an exterior surface 42 of outer wall 22*a* of cold environment 24. In a preferred embodiment, an adhesive 52, such as an ethyl cyanoacrylate adhesive, is provided to secure radial flange 36 to exterior surface 42 of cold environment 24. One preferred adhesive is Saf-T-Loc®. Instant Bonder IB 1500 which is available from Saf-T-Loc International Corporation, Lombard, Ill., USA. Alternately, other adhesives and attachment devices may be used to secure flange 36 to exterior surface 42 of cold environment 24. During installation of dry sprinkler installation 10 in a cold environment, such as a freezer, opening 21 is formed in ceiling or wall 22 of the freezer. Opening 21 is generally about 1.75 inches in diameter although the size of the opening will vary with the outer diameter of the supply conduit 12. Next, the supply conduit 12 is inserted up through opening 21 and sealing device 16 is slid over supply conduit 12 exteriorly of the freezer and positioned adjacent the exterior surface 42 of outer wall 22*a* of the freezer ceiling. The contact surface of the exterior wall is wiped clean with a damp cloth and the adhesive is applied to the contact surface (or the radial flange). The radial flange 36 is now pressed onto the adhesive and the contact surface to secure sealing device 16 to exterior surface 42 of the freezer. Next, two nylon ties or the like are used to secure first end 30 of sealing device 16 to supply conduit 12.

Figure 6:
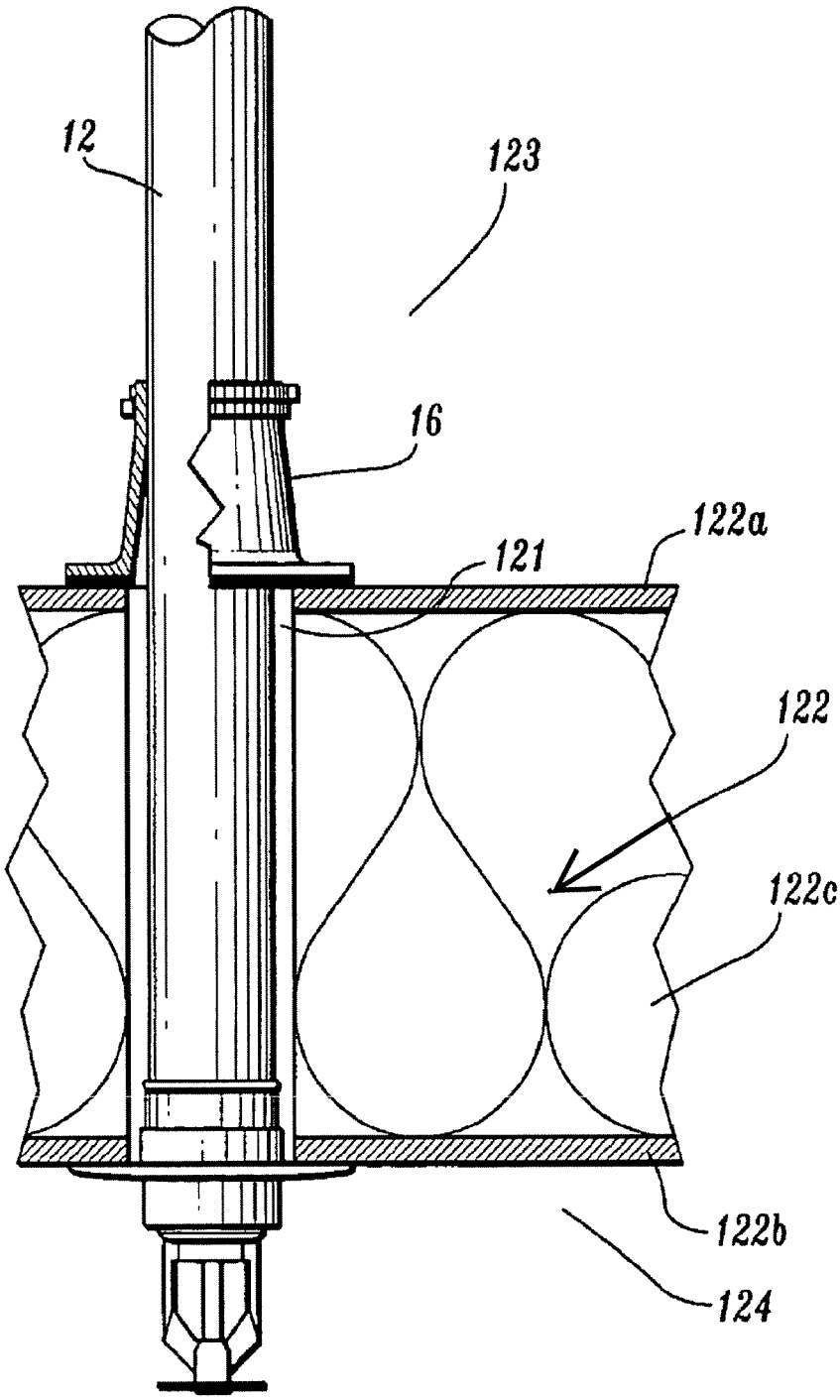
FIG. 6 is a side cross-sectional view of an alternative embodiment of the presently disclosed dry sprinkler installation and sealing device.

In an alternative embodiment illustrated in FIG. 6, supply conduit 12 is positioned to extend through an opening 121 in a wall 122, e.g., the ceiling, of a heated room 124. The cold environment in this embodiment may be, for example, an unheated attic space 123 above the heated room. Typically, wall 122 will include an outer wall 122*a*, an inner wall 122*b* and an insulated central portion 122*c* positioned between the inner and outer walls 122*a* and 122*b*. Supply conduit 12 is positioned through hole 121 such that sprinkler head 14 is positioned within heated room 124 and sealing device 16 is positioned about supply conduit 12 adjacent outer wall 122*a* in the manner described in connection with the previous embodiments to provide an airtight seal between supply conduit 12 and wall 122.

It will be understood that various modifications may be made to the embodiments disclosed herein. For example, the sealing device may assume other configurations which are capable of providing an adequate seal and radial and axial adjustment of the sprinkler head and supply conduit. Further, the order of the method steps may be changed or varied slightly. For example, the sealing device may be positioned about the supply conduit prior to inserting the supply conduit through the opening in the cold environment. Therefore, the above description should not be construed as limiting, but merely as exemplifications of preferred embodiments. Those skilled in the art will envision other modifications within the scope and spirit of the claims appended hereto.

The invention claimed is:

1. A dry sprinkler installation comprising:

a support structure having an insulated wall with interior and exterior surfaces defining opposing openings communicating with a passage wall defining a passage extending between the interior and exterior surfaces;

a layer of insulation disposed between the interior and exterior surfaces of the insulated wall;

a dry sprinkler having a casing and a sprinkler head supported at one end of the casing, the sprinkler head including a deflector and a thermal response device, the sprinkler head extending through the opening of the interior surface of the insulated wall, an exterior surface of the casing and the passage wall defining a uniform annular air gap between the casing and the layer of insulation, the space also including a passage air pocket consisting of air disposed in the space; and a flexible annular sealing device positioned about the casing, the flexible annular sealing device including a body defining a throughbore having a first end having a curved planar surface dimensioned to sealingly engage the outer circumference of the casing and a second end having a flat planar surface positioned to sealingly engage the exterior surface of the insulated wall, the throughbore defining a throughbore air pocket consisting air disposed in the throughbore, the throughbore air pocket communicating with the passage air pocket through the opening of the exterior surface of the insulated wall.

2. A dry sprinkler installation according to claim 1, wherein the body of the flexible annular sealing device is substantially conical.

3. A dry sprinkler installation according to claim 2, wherein the second end of the flexible annular sealing device includes a radial flange.

4. A dry sprinkler installation according to claim 3, further including an adhesive for securing the radial flange of the annular sealing device to the casing.

5. A dry sprinkler installation according to claim 4, wherein the adhesive is an ethyl cyanoacrylate adhesive.

6. A dry sprinkler installation according to claim 1, wherein the body of the flexible annular sealing device includes a flexible bellows.

7. A dry sprinkler installation according to claim 1, wherein the flexible annular sealing device is constructed from a rubber.

8. A dry sprinkler installation according to claim 7, wherein the flexible material is an EPDM rubber.

9. A dry sprinkler installation according to claim 1, further including at least one tie for securing the first end of the annular sealing device about the casing.

10. The dry sprinkler installation of claim 1, the curved planar surfaced disposed orthogonally to the flat planar surface.

11. A dry sprinkler system, comprising:

an insulated wall having insulation, the insulated wall defining a passage traversing between interior and exterior surfaces of the insulated wall, the exterior surface defining a passage opening communicating with the passage;

a seal disposed adjacent to the exterior surface of the insulated wall, the seal having a seal wall defining an interior chamber of the seal communicating with the entire passage of the insulated wall, the seal wall narrowing in a direction away from the passage of the insulated wall to terminate at a curved planar surface defining a seal opening disposed at a distance from the insulated wall, the seal opening being aligned with the passage opening, the seal having a flat planar surface affixed to the exterior surface of the insulated wall; and a dry sprinkler including a casing disposed in the passage of the wall and the interior chamber of the seal to engage the curved planar surface of the seal and obstruct the seal opening and forms an annular uniform air gap in the passage of the insulated wall between the casing and the insulation.

12. The dry sprinkler system of claim 11, the curved planar surface disposed orthogonally to the flat planar surface.

13. A method of sealing a passage traversing between interior and exterior surfaces of an insulated wall, the exterior surface defining a passage opening communicating with the passage of the insulated wall, comprising:

positioning a seal adjacent the exterior surface of the insulated wall, the seal having a seal wall defining an interior chamber of the seal communicating with the entire passage of the insulated wall, the seal wall narrowing in a direction away from the passage of the insulated wall to terminate at a curved planar surface defining a seal opening disposed at a distance from the insulated wall;

aligning the seal opening with the passage opening;

disposed a dry sprinkler having a casing in the passage of the insulated wall and the interior chamber of the seal to engage the curved planar surface and obstruct the seal opening, and form an annular uniform air gap in the passage of the insulated wall between the casing and insulation of the insulated wall; and affixing a flat planar surface of the seal to the exterior surface of the insulated wall.

14. A dry sprinkler system comprising:

a passage traversing between opposing interior and exterior surfaces of an insulated wall, the exterior surface of the insulated wall having insulation defining a passage opening communicating with the passage of the insulated wall;

a flange disposed adjacent to the exterior surface of the insulated wall, the flange having a first surface abutting the exterior surface of the insulated wall and a second surface opposite to the first surface, the first surface being a flat planar surface defining a first opening of the seal wall and an interior chamber of the seal wall disposed between the first opening and the flange, the flange having a first surface, the first surface being a flat planar surface, a seal wall extending from the second surface of the flange to coverage to a curved planar surface defining a first opening of the seal wall and an interior chamber of the seal wall disposed between the first opening and the flange, the flange first and second surfaces defining a second opening communicating with the interior chamber and with the entire passage of the insulated wall, the first and second openings being aligned with the passage opening, the flat planar surface of the flange being affixed to the exterior surface of the insulated wall; and a dry sprinkler having a casing disposed in the passage of the insulated wall and the interior chamber of the seal wall to engage the curved planar surface and obstruct the first opening, and form an annular uniform air gap in the passage of the insulation wall between the casing and the insulation.

15. The dry sprinkler system of claim 14, the curved planar surface disposed orthogonally to the flat planar surface.

16. A method of sealing a passage traversing between opposing interior and exterior surfaces of an insulated wall, the exterior surface defining a passage opening communicating with the passage of the insulated wall, comprising:

positioning a flange adjacent the exterior surface of the insulated wall, the flange having a first surface abutting the exterior surface of the insulated wall and second surface opposite to the first surface, the first surface being a flat planar surface, a seal wall extending from the second surface of the flange to converge to a curved planar surface defining a first opening of the seal wall and an interior chamber of the seal wall disposed between the first opening and the flange, the flange first and second surfaces defining a second opening communicating with the interior chamber and with the entire passage of the insulated wall;

aligning the first and second openings with the passage opening;

disposing a dry sprinkler having a casing in the passage of the wall and the interior chamber of the seal wall to engage the curved planar surface and obstruct the first opening, and form an annular uniform air gap in the passage of the insulation wall between the casing and the insulation; and affixing the flat planar surface of the flange to the exterior surface of the insulated wall.

17. A dry sprinkler system, comprising:

An insulated wall having a layer of insulation disposed between opposing interior and exterior surface of the insulated wall, the exterior surface defining a passage opening communicating with a passage extending through the insulated wall;

a dry sprinkler having a casing disposed in the passage of the insulated wall to extend through the passage opening and form an annular uniform air gap in the passageway of the insulated wall between the casing and the layer of insulation;

a seal wall disposed on a longitudinal axis, the seal wall having first and second portions, the first portion of the seal wall having a flat planar surface extending about the axis and abutting the exterior surface of the insulated wall, the send portion of the seal wall having a curved planar surface extending about the axis and abutting the casing of the dry sprinkler, the seal wall being exposed to air communicating with the entire passage of the insulated wall-through the passage opening.

18. The dry sprinkler system of claim 17, the curved planar surface disposed orthogonally to the flat planar surface.

19. The dry sprinkler system of claim 17, wherein the seal wall comprises an interior chamber.

20. A method of sealing a passage traversing an insulated wall between opposing interior and exterior surfaces of an insulated wall and through a layer of insulation of the insulated wall disposed between the interior and exterior surfaces, the exterior surface defining a passage opening communicating with the passage of the insulated wall, comprising:

disposing a dry sprinkler having a casing in the passage of the insulated wall to extend through the passage opening and form an annular uniform air gap in the passage of the insulated wall between the casing and the insulation;

positioning a seal wall on a longitudinal axis extending through the passage of the insulated wall, a first end of the seal wall having a flat planar surface extending about the axis and abutting the exterior surface of the insulated wall, a second end of the seal wall having a curved planar surface extending about the axis and abutting the dry sprinkler, the seal wall defining an interior chamber communicating with the entire passage of the insulated wall; and affixing the flat planar surface of the seal first end of the seal wall to the exterior surface of the insulated wall.

21. A dry sprinkler system, comprising:

an insulated wall having a layer of insulation disposed between opposing interior and exterior surfaces of the insulated wall, the layer of insulation defining a passage extending through the insulated wall;

a dry sprinkler having a casing disposed in the passage of the insulated wall to form an annular uniform air gap in the passage of the insulated wall between the casing and the insulation, the dry sprinkler having a deflector located in an environment proximate the interior surface and the casing being disposed in at least the passageway and an environment proximate the exterior surface;

a seal having a first portion having a flat planar surface extending about the axis and abutting the exterior surface of the insulated wall, and a second portion having a curved planar surface extending about the axis and secured about the casing; and means for communicating air along the entire casing disposed in the passageway to the seal.

22. The dry sprinkler of claim 21, wherein the means for communicating comprises a passage opening along the exterior surface of the insulated wall.

23. A dry sprinkler system, comprising:

an insulated wall having a layer of insulation disposed between opposing interior and exterior surfaces of the insulated wall, the layer of insulation defining a passage extending through the insulated wall;

a dry sprinkler having a casing disposed in the passage of the insulated wall, the dry sprinkler having a deflector located in an environment proximate the interior surface and the casing being disposed in at least the passageway and an environment proximate the exterior surface, and forming an annular uniform air gap in the passage of the insulated wall between the casing and the insulation;

a seal having a first portion having a flat planar surface extending about the axis and abutting the exterior surface of the insulated wall, and a second portion having a curved planar surface extending about the axis and abutting the dry sprinkler so that stagnant air locates along a portion of the casing proximate the seal and is disposed in communication with the air gap.

* * * * *